US009895881B2

(12) United States Patent
Kihira et al.

(10) Patent No.: US 9,895,881 B2
(45) Date of Patent: Feb. 20, 2018

(54) IMAGE FORMING DEVICE AND LIQUID DROPLET DISCHARGING DEVICE WHICH APPLY A VOLTAGE PRIOR TO PRINTING

(71) Applicants: Takakazu Kihira, Ibaraki (JP); Naoya Kondo, Kanagawa (JP)

(72) Inventors: Takakazu Kihira, Ibaraki (JP); Naoya Kondo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/145,312

(22) Filed: May 3, 2016

(65) Prior Publication Data

US 2016/0339694 A1 Nov. 24, 2016

(30) Foreign Application Priority Data

May 18, 2015 (JP) ..... 2015-101147

(51) Int. Cl.
*B41J 2/045* (2006.01)
*B41J 2/165* (2006.01)

(52) U.S. Cl.
CPC ..... *B41J 2/04588* (2013.01); *B41J 2/04581* (2013.01); *B41J 2/16508* (2013.01)

(58) Field of Classification Search
CPC . B41J 2/04588; B41J 2/16508; B41J 2/04581
See application file for complete search history.

(56) References Cited

U.S. PATENT DOCUMENTS

2005/0052492 A1* 3/2005 Ikeda ..... B41J 2/04541 347/40
2010/0103212 A1* 4/2010 Tabata ..... B41J 2/04548 347/10
2010/0315471 A1 12/2010 Kihira et al.
2015/0263263 A1 9/2015 Akiyama et al.

FOREIGN PATENT DOCUMENTS

JP 7-092752 4/1995
JP 9-141866 6/1997
JP 2013-022931 2/2013
JP 2015-000560 1/2015

* cited by examiner

*Primary Examiner* — Henok Legesse
(74) *Attorney, Agent, or Firm* — Oblon, McClelland, Maier & Neustadt, L.L.P.

(57) ABSTRACT

A liquid droplet discharging device includes a liquid droplet discharging head including a nozzle hole, a pressurized liquid chamber communicating with the nozzle hole, a vibration plate constituting a side of the pressurized liquid chamber, a control device, and a thin film piezoelectric substance to vibrate the vibration plate by a drive voltage to discharge liquid droplets and a voltage application device to apply a voltage waveform having a voltage equal to or greater than the drive voltage between when the main power is activated and when first print starts.

7 Claims, 9 Drawing Sheets

| | EXAMPLE 1 | EXAMPLE 2 | COMPARATIVE EXAMPLE 1 | COMPARATIVE EXAMPLE 2 |
|---|---|---|---|---|
| FIRST TIME | 0.3% | 0.7% | 1.5% | 0.2% |
| SECOND TIME | 0.5% | 0.6% | 1.1% | 0.1% |
| THIRD TIME | 0.4% | 0.4% | 1.4% | 0.2% |

IMAGE FORMING DEVICE AND LIQUID DROPLET DISCHARGING DEVICE WHICH APPLY A VOLTAGE PRIOR TO PRINTING

CROSS-REFERENCE TO RELATED APPLICATIONS

This patent application is based on and claims priority pursuant to 35 U.S.C. §119(a) to Japanese Patent Application No. 2015-101147, filed on May 18, 2015, in the Japan Patent Office, the entire disclosure of which is hereby incorporated by reference herein.

BACKGROUND

Field of the Invention

The present invention relates to a liquid droplet discharging device.

Description of the Related Art

As a printer, a facsimile machine, a photocopier, a plotter, or a multifunction peripheral (serving as any combination of a printer, a facsimile machine, and a photocopier), for example, an inkjet recording device (liquid droplet discharging device) having a liquid droplet discharging head to discharge liquid droplets such as ink is generally used.

The liquid discharging head is known to have a configuration including a nozzle to discharge liquid droplets such as ink, a liquid chamber (also referred to as a pressurized liquid chamber, a pressure chamber, a pressurized chamber, a discharging chamber, etc.), and an electromechanical transduction element such as thin film piezoelectric substance (piezoelectric element). In this liquid droplet discharging head, the thin film piezoelectric substance vibrates to distort a vibration plate constituting part of the walls of the liquid chamber when a voltage is applied to the thin film piezoelectric substance. The distortion of the vibration plate applies a pressure to liquid in the liquid chamber so that droplets of the liquid are discharged through nozzles.

The liquid droplet discharging head using the thin film piezoelectric substance is vulnerable to stress from the outside, which stems from the structure of the thin film piezoelectric substance. Therefore, taking into account the properties changing easily due to the heat stress difference between the members of the head, stability of discharging liquid droplets is attempted to be secured by stabilizing the properties with processing such as polarization processing, aging (application of waveform) in the silicon process.

SUMMARY OF THE INVENTION

According to the present disclosure, provided is an improved liquid droplet discharging device including a liquid droplet discharging head including a nozzle hole, a pressurized liquid chamber communicating with the nozzle hole, a vibration plate constituting a side of the pressurized liquid chamber, a control device, and a thin film piezoelectric substance to vibrate the vibration plate by a drive voltage to discharge liquid droplets and a voltage application device to apply a voltage waveform having a voltage equal to or greater than the drive voltage between when the main power is activated and when a first print starts.

BRIEF DESCRIPTION OF THE SEVERAL VIEWS OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein.

Figure 1:
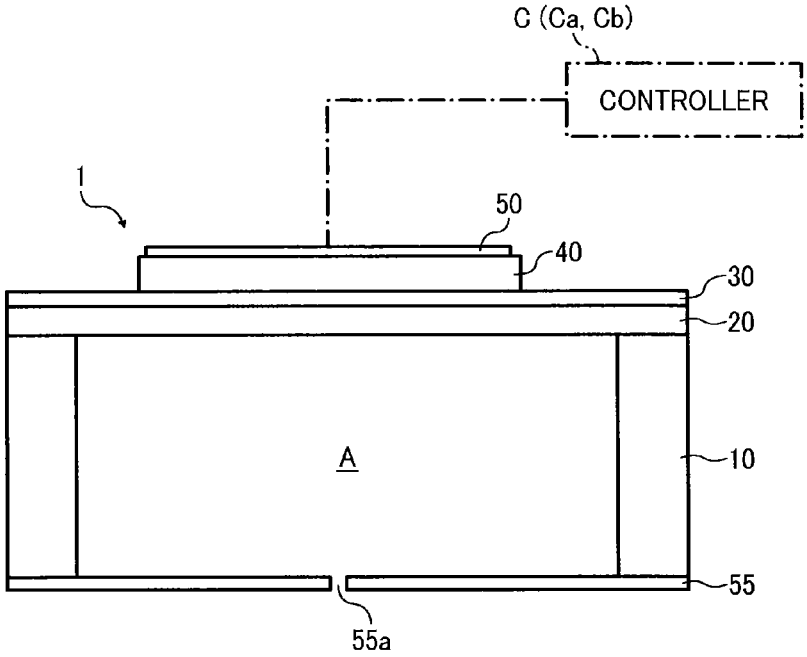
FIG. 1 is a schematic front view of the liquid droplet discharging head relating to an example for use in the liquid droplet discharging head according to an embodiment of the present invention.

The accompanying drawings are intended to depict example embodiments of the present invention and should not be interpreted to limit the scope thereof. The accompanying drawings are not to be considered as drawn to scale unless explicitly noted.

DESCRIPTION OF THE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

The liquid droplet discharging device relating to one embodiment of the present disclosure is described with reference to the accompanying drawings.

FIG. 1 is a side view of the liquid droplet discharging head relating to an example for use in the liquid droplet discharging head relating to one embodiment of the present disclosure.

Figure 2:
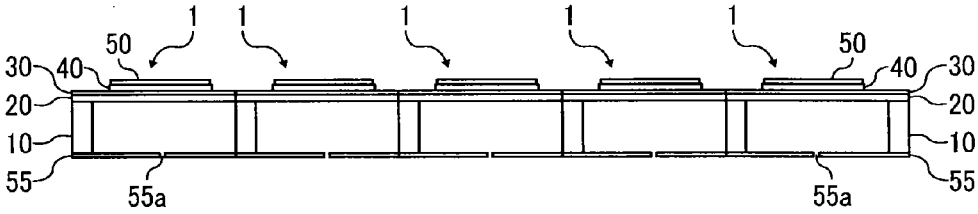
FIG. 2 is a side view of the liquid droplet discharging head relating to the example illustrated in FIG. 1.

FIG. 2 is a side view of the liquid droplet discharging device relating to the example.

The schematic mechanical configuration of a liquid droplet discharging head 1 relating to the example is illustrated in FIGS. 1 and 2. That is, the liquid droplet discharging head 1 relating to the example is formed by sequentially laminating and agglutinating a vibration plate 20, a bottom electrode 30, a thin film piezoelectric substance 40, and a top electrode 50 on the upper site of a pressure chamber substrate 10. A nozzle plate 55 having nozzle holes 55*a* formed thereon is agglutinated at the bottom site of the pressure chamber substrate 10.

In the present embodiment, the pressure chamber substrate 10 is formed by silicon single crystal substrate having a thickness of from 10 to 600 μm to have a predetermined frame-form partitioning a pressurized liquid chamber A to temporarily store liquid (hereinafter referred to as liquid ink).

The plane direction of the silicon single crystal substrate has three kinds of (100), (110), and (111). Generally, (100) and (111) are widely used. In the present embodiment, a silicon single crystal substrate having a plane direction of (100) is mainly adopted.

To manufacture the pressurized liquid chamber A as illustrated in FIG. 1, silicon single crystal substrate is processed utilizing etching, in particular anisotropic etching in general. Anisotropic etching utilizes characteristics that the etching speed is different about the plane direction of the crystal structure. For example, as for anisotropic etching dipped in an alkali solution such as potassium hydroxide (KOH), the etching speed of (111) plane is about a four hundredth of that of (100) plane.

Therefore, while a structure having a gradient of about 54 degree at the plane direction of (100), a deep ditch can be formed at the plane direction of (110). Consequently, it is possible to increase the arrangement density while maintaining a higher rigidity. In the present embodiment, a silicon single crystal having a plane direction of (110) can be used. To use this substrate, it is necessary to bear it in mind that silicone dioxide ($SiO_2$) serving as a masking material may also be etched.

The vibration plate 20 constitutes a side plane of the pressurized liquid chamber A and the exterior circumference is agglutinated to the pressure chamber substrate 10. This vibration plate 20 is distorted and displaced under the force generated by the thin film piezoelectric substance (electromechanical transduction film) 40 to discharge the liquid droplet (hereinafter referred to as ink droplet) in the pressurized chamber A. Therefore, it is preferable that the vibration plate 20 have a predetermined rigidity.

The vibration plate 20 can be made of materials prepared by a chemical vapor deposition (CVD) method using silicon (Si), $SiO_2$, and silicon nitride ($Si_3N_4$). In addition, it is preferable to select materials having a linear expansion coefficient close to those of the bottom electrode 30 and the thin film piezoelectric substance 40 as illustrated in FIG. 1. In particular, for the thin film piezoelectric substance 40, lead zirconate titanate (PZT) is used as a general material. Taking this into account, it is preferable to use a material having a linear expansion coefficient of $5\times10^{-6}$ to $10\times10^{-6}$ close to the linear expansion coefficient of $8\times10^{-6}$ (1/K). Furthermore, it is more preferable to use a material having a linear expansion coefficient of $7\times10^{-6}$ to $9\times9^{-6}$.

Specific examples thereof include, but are not limited to, aluminum oxide, zirconium oxide, iridium oxide, ruthenium oxide, tantalum oxide, hafnium oxide, osmium oxide, rhenium oxide, rhodium oxide, palladium oxide, and compounds thereof. These are used for manufacturing by a spin coater using a sputtering method, a sol-gel method, etc. The thickness of the film is preferably from 0.1 to 10 μm and more preferably from 0.5 to 3 μm. If the thickness is less than this range, it is difficult to process the pressurized liquid chamber A as illustrated in FIG. 1. If the thickness is larger than the range, the vibration plate 20 is not easily distorted or displaced, thereby destabilizing discharging of the ink droplet.

The bottom electrode 30 is preferably made of metal or a combination of metal and metal oxide. In both cases, an adhesion film is disposed between the vibration plate 20 and the metal film to prevent peeling-off, etc. The metal electrode film and the metal oxide electrode film including the adhesion film are described in detail.

Adhesion Layer

After sputtering film formation of titanium (Ti), the titanium film is thermally oxidized by a rapid thermal annealing (RTA) device in $O_2$ atmosphere at in temperature range of from 650 to 800 degrees C. for 1 to 30 minutes. To produce a titanium oxide film, reactive sputtering can also be used but thermal oxidization method by hot temperatures of titanium film is preferable thereto. In the manufacturing by the reactive sputtering, a silicone substrate is heated at high temperatures, which requires a special sputtering chamber configuration. Furthermore, the crystalline property of titanium oxide ($O_2$) film is better by oxidation by an RTA device than oxidization by a typical furnace. This is because, according to oxidization by a typical heating furnace, easily-oxidized titanium film makes many crystal structures at low temperatures, which have to be destroyed once. Therefore, oxidization by RTA is advantageous to create good crystals because the temperature rising speed is high. In addition to titanium (Ti), tantalum (Ta), iridium (Ir), ruthenium (Ru), etc. can be used.

The film thickness is preferably from 10 to 50 nm and more preferably from 15 to 30 nm. Below this range, adhesion property becomes a concern. Above this range, the quality of the crystal of the electrode film formed on the adhesion film is adversely affected.

Metal Electrode Film

Platinum has been used as the metal material because of its good heat resistance and low reactivity. However, since platinum is not sufficiently durable to lead, platinum group elements such as iridium or alloy of platinum group such as platinum and rhodium are also used. In addition, since adhesion property with the foundation (in particular $SiO_2$) is bad when platinum is used, it is preferable to laminate the adhesion layer first. The metal electrode film is generally manufactured by a sputtering method and vacuum filming such as vacuum deposition. The thickness of the film is preferably from 80 to 200 nm and more preferably from 100 to 150 nm. Below this range, it is not possible to supply sufficient current as the common electrode, thereby causing a problem when ink droplets are discharged. Moreover, the film thickness above this range invites cost increase when an expensive material of platinum group elements is used. If platinum is used, the surface becomes coarse as the film thickness increases. This adversely affects the surface roughness and crystalline orientation property of the oxide electrode film and PZT formed on the metal electrode film, causing such a problem that displacement is not sufficient to discharge ink droplets.

Oxide Electrode Film

Oxide electrode film is preferably made of ruthenium oxide ($SrRuO_3$). In addition, materials represented by Srx (A) (1−x)Ruy(1−y), A=Ba or Ca, B=Co or Ni, and x and y=0 to 0.5 are suitable. As the film formation method, a sputtering method is utilized. The film quality of the thin film of $SrRuO_3$ changes depending on sputtering conditions. In particular, if the crystalline orientation counts and (111) orientation is made about the thin film of $SrRuO_3$ like Pt (111), it is preferable to heat a substrate at 500 degrees C. or higher to form a film.

For example, as for the typical SRO film formation condition, after room temperature film formation, heat oxidization is conducted at crystallization temperature (650 degrees C.) at RTA processing. In this case, the SRO film is sufficiently crystallized and a sufficient specific resistance is obtained as the electrode. However, as for the crystal orientation of the film, (110) is orientated first and PZT formed thereon also tends to be (110) oriented.

As for the crystalline property of the SRO formed on Pt (111), since the lattice constants of Pt and SRO are close, it is difficult to distinguish one from the other because 2θ positions of SRO (111) and Pt (111) overlap according to typical θ-2θ measuring. With regard to Pt, according to the extinction rule, no diffraction intensity is observed at the position around 32 degrees (2θ slanted as Psi=35 degrees) since the diffraction lines cancel each other out. Therefore, by slanting Psi orientation about 35 degrees and using the peak intensity around 2θ being approximately 32 degrees, it can be confirmed whether SRO is preferably-oriented to (111).

When 2θ is fixed to 32 degrees and Psi is changed, diffraction intensity is little observed at SRO (110) when Psi is 0 degree but around 35 degrees. Taking this into account, it was confirmed that SRO was (111) oriented about what was manufactured under the film formation condition. In addition, with regard to SRO forced by the room temperature film formation and RTA processing, diffraction intensity of SRO (111) is observed when Psi is 0 degree.

Although details are described later, when estimating how much the displacement amount after driving deteriorates in comparison with the initial displacement after continuous operations as an piezoelectric actuator, the orientation property of PZT had a great adverse impact and (110) was not sufficient to limit the deterioration. Moreover, when the surface roughness of the SRO film is observed, it affects the film formation temperature and the surface roughness is extremely small in the temperature range of from room temperature to 300 degrees C. The surface roughness is 2 nm or less. With regard to the roughness, the surface roughness (average roughness) as measured by an atomic force microscope (AFM) is used as the index.

As for the surface roughness, the surface is extremely flat. However, the crystalline property is not sufficient or the initial displacement and the deterioration of the displacement after continuous driving as the piezoelectric actuator of PZT film-formed thereafter are not sufficient. The surface roughness is preferably from 4 to 15 nm and more preferably from 6 to 10 nm. Outside this range, the insulation resistance of PZT film-formed thereafter is extremely bad, easy to leak. Therefore, to obtain the crystalline property and the surface roughness as described above, the film formation temperature is from 500 to 700 degrees C. and preferably from 520 degrees C. to 600 degrees C.

With regard to the composition ratio between Sr and Ru after film formation, Sr/Ru is preferably from 0.82 to 1.22. Outside this range, the specific resistance becomes large, so that electroconductivity as an electrode is not obtained. Furthermore, the thickness of SRO film is preferably from 40 to 150 nm and more preferably from 50 to 80 nm. Below this range, sufficient initial displacement is not obtained and the deterioration of the displacement after continuous driving is not sufficiently prevented. Also, a feature as a stop etching layer to limit over-etching of PZT is not easily obtained. Above this range, the insulation resistance of PZT film-formed thereafter is extremely bad, easy to leak. In addition, the specific resistance is preferably $5\times10^{-3}$ Ω·cm or less and more preferably $1\times10^{-3}$ Ω·cm or less. Above this range, the contact resistance at the interface is not sufficiently obtained as the common electrode so that it is not possible to supply a sufficient current as the common electrode, thereby causing a problem when ink droplets are discharged.

The thin film piezoelectric substance 40 described above is a pressure generating device to apply a pressure to the pressurized liquid chamber A so that the liquid ink supplied to the pressurized liquid chamber A is discharged from the nozzle 55*a*. The thin film piezoelectric substance 40 electrically connects alternately the interior electrodes with individual electrodes and common electrodes serving as the exterior electrodes to impart drive signals to each electrode.

PZT is mainly used as the material of the thin film piezoelectric substance 40. PZT is a solid solution of zirconate lead ($PbZrO_3$) and titanate lead ($PbTiO_3$) and the characteristics thereof depend on the ratio thereof.

The composition demonstrating excellent piezoelectric characteristics generally has a ratio of $PbZrO_3$ and $PbTiO_3$ of 53:47, which is represented by the following chemical formula: Pb(ZrO.53, TiO.47)$O_3$, general PZT (53/47). A specific example of the complex oxide other than PZT is barium titanate. In this case, it is possible to dissolve a barium alkoxide and titanium alkoxide compound as starting materials in a common solvent to prepare a precursor solution of barium titanate.

These materials are complex oxides represented by the chemical formula $ABO_3$, where A=Pb, Ba, or Sr, B=Ti, Zr, Sn, Ni, Zn, Mg, or Nb. Specifically, these are (Pb1−x, Ba) (Zr, Ti)$O_3$ and (Pb1−x, Sr) (Zr, Ti)$O_3$, where part of Pb of the A site is substituted by Ba or Sr. Such substitution is conducted by any of di-valent elements. Due to this substitution, deterioration of characteristics caused by evaporation of lead during heat processing is reduced.

The thin film piezoelectric substance 40 is manufactured by a spin coater utilizing a sputtering method or a sol-gel method. Since this requires patterning, a desired pattern is obtained by photolithoetching, etc. If PZT is manufactured by the sol-gel method, it is possible to dissolve a zirconium alkoxide and titanium alkoxide compound as starting materials in methoxyethanol as a common solvent to prepare a uniform solution to prepare a precursor solution of PZT. Since metal alkoxide compounds are susceptible to hydrolysis due to moisture in the atmosphere, it is appropriate to add a stabilizer such as acetylacetone, acetic acid, and diethanolamine to the precursor solution in a suitable amount.

If PZT film is obtained all over the surface of the foundation substrate, applied film is formed by a solution application method such as spin coating followed by each heating treatment of solvent drying, heat decomposition, and crystallization. Since transformation from applied film to crystallized film involves volume contraction, the concentration of the precursor is adjusted to have a film thickness of 100 nm or less in a single process to obtain a crack-free film.

The thickness of the thin film piezoelectric substance 40 is preferably from 0.5 to 5 μm and more preferably from 1 to 2 μm. Below this range, it is not possible to achieve sufficient displacement. Above this range, the number of processes increases and takes a longer time because a number of layers are laminated.

In addition, the relative permittivity is preferably 600 to 2,000 and more preferably 1,200 to 1,600. Below this range, it is not possible to obtain sufficient displacement characteristics. Above this range, polarization treatment becomes insufficient and the degradation of displacement after continuous driving is not prevented sufficiently.

The top electrode 50 is preferably made of metal or a combination of an oxide and metal. The oxide electrode film and metal electrode film are described in detail next.

Oxide Electrode Film

The thickness of SRO film as the oxide electrode film is preferably from 20 to 80 nm and more preferably from 40 to 60 nm. Below this range, the initial displacement and properties of deterioration of displacement become not satisfactory. Above this range, the insulation resistance of PZT film-formed thereafter is extremely bad, easy to leak.

Metal Electrode Film

The thickness of the metal electrode film is preferably from 30 to 200 nm and more preferably from 50 to 120 nm. Below this range, it is not possible to supply sufficient current as the individual electrode, thereby causing a problem when ink droplets are discharged. Furthermore, the film thickness above this range invites cost increase by using an expensive material of platinum group elements. Also, as the film thickness increases, the surface roughness increases. As a consequence, problems such as peeling-off of film tend to occur in the process when manufacturing an electrode via an insulation protection film.

Manufacturing of the liquid droplet discharging head 1 is described in detail. A thermal oxidation film (thickness of 1 micron meter) is formed on 6-inch silicon wafer and a titanium film (thickness of 30 nm) is formed by a sputtering device as the adhesion film of a bottom electrode. Subsequent to thermal oxidization at 750 degrees C. using RTA, platinum film (thickness of 100 nm) as a metal film and SrRuO film (thickness 60 nm) as an oxide film were formed by sputtering. The substrate heating temperature during film formation by sputtering is 550 degrees C. Next, a solution adjusted to Pb:Zr:Ti=114:53:47 as a piezoelectric substance film is prepared and a film is formed by a spin coating method.

With regard to specific synthesis of a precursor coating liquid, lead (II) acetate trihydrate, titanium isopropoxide, normalzirconium propoxide are used as the starting materials. Crystal water of lead acetate is dissolved in methoxyethanol and dehydrated. The amount of lead is set to be excessive for stoichiometric composition. This is to prevent deterioration of crystallinity caused by so-called lead missing during heat treatment. Titanium isopropoxide and normal zirconium propoxide are dissolved in methoxyethanol followed by alcohol exchange reaction and esterification reaction. The resultant is mixed with the methoxyethanol solution in which lead acetate is dissolved to synthesize a precursor solution of PZT.

The concentration of PZT is adjusted to 0.5 mol/litter. Using this solution, a film is formed by spin coating. After film formation, the film is dried at 120 degrees C. and thermally decomposed at 500 degrees C. After the thermal decomposition of the third layer, crystallization heat treatment (temperature: 75 degrees C.) is conducted by RTA. The thickness of the PZT is 240 nm. This process is repeated eight times in total (24 layers) to obtain PZT having a thickness of about 2 μm.

As the oxide film of the top electrode 50, SrRuO film (thickness of 40 nm and Pt film (thickness of 125 nm) as the metal film are sputtered. Thereafter, photoresist (TSMR 8800, manufactured by TOKYO OHKA KOGYO CO., LTD.) is formed by a spin coating method and a resist pattern is formed by a typical photolithography. The Pt film and the oxide film are subject to etching using an ICP etching device (manufactured by SAMUCO Inc.). Thereafter, the resultant is subject to resist stripping treatment for 30 minutes using an amine-based stripping solution by a resist stripping device (manufactured by Semitool, Inc.) and ashing treatment for 3 minutes using an asher (manufactured by Canon Inc.) to conduct patterning of the top electrode 50 (individual electrode). Similarly, after a resist pattern is formed by photolithography, the piezoelectric film is subject to etching followed by resist stripping and ashing for patterning the tpiezoelectric film. Next, after the pattern of electrode (common electrode) is formed by photolithography, resist stripping and ashing are conducted for patterning the bottom electrode (common electrode).

The liquid droplet discharging head 1 is manufactured by using the thin film piezoelectric substance 40. The manufacturing process of the liquid droplet discharging head 1 illustrated in FIGS. 1 and 2 includes removing etching from the rear side and agglutinating the nozzle plate 55 to form the pressurized liquid chamber A. This method of manufacturing the head is conducted by a known head manufacturing process. In FIGS. 1 and 2, the description and illustration of the liquid supplying device, flow paths, and fluid resistance are omitted.

Figure 3:
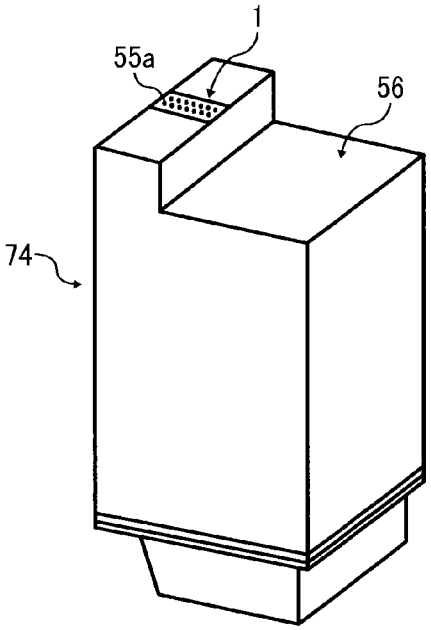
FIG. 3 is a perspective view of an ink cartridge including the liquid droplet discharging head illustrated in FIG. 1.

FIG. 3 is a perspective view of an ink cartridge including the liquid droplet discharging head relating to the example described above. An ink cartridge 74 illustrated in FIG. 3 includes the liquid droplet discharging head 1 having the nozzle holes 55*a* described above and an ink tank 56 integrated with the liquid droplet discharging head 1 to supply the liquid ink to the liquid droplet discharging head 1.

In the case of this ink tank integrated recording head, a low yield of the head during manufacturing immediately invites faults of the entire ink cartridge. Therefore, improvement of liquid discharging properties directly leads to improvement of reliability of the head-integrated ink cartridge.

Figure 4:
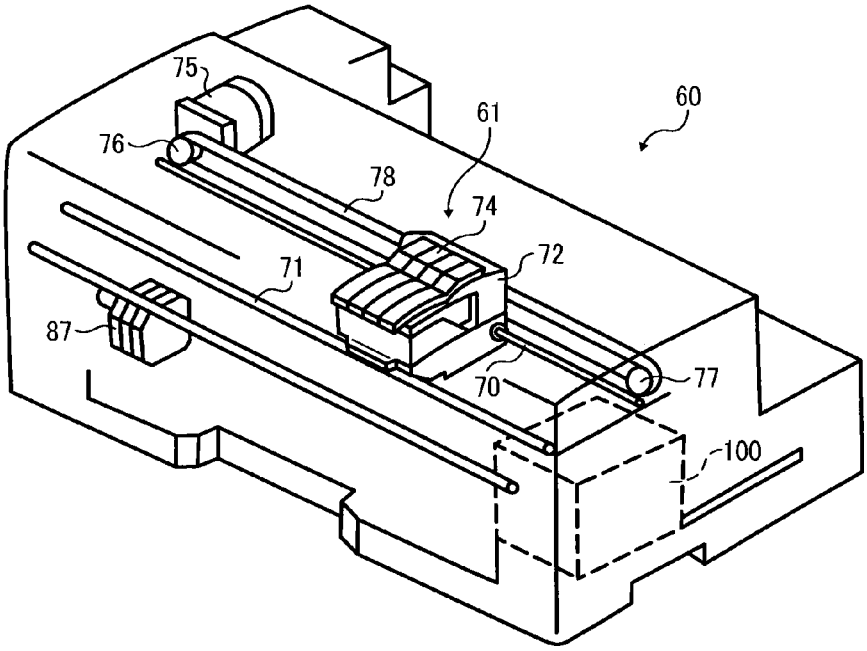
FIG. 4 is a perspective diagram illustrating a configuration of the image forming apparatus as an example of the liquid droplet discharging device according to an embodiment of the present invention.
Figure 5:
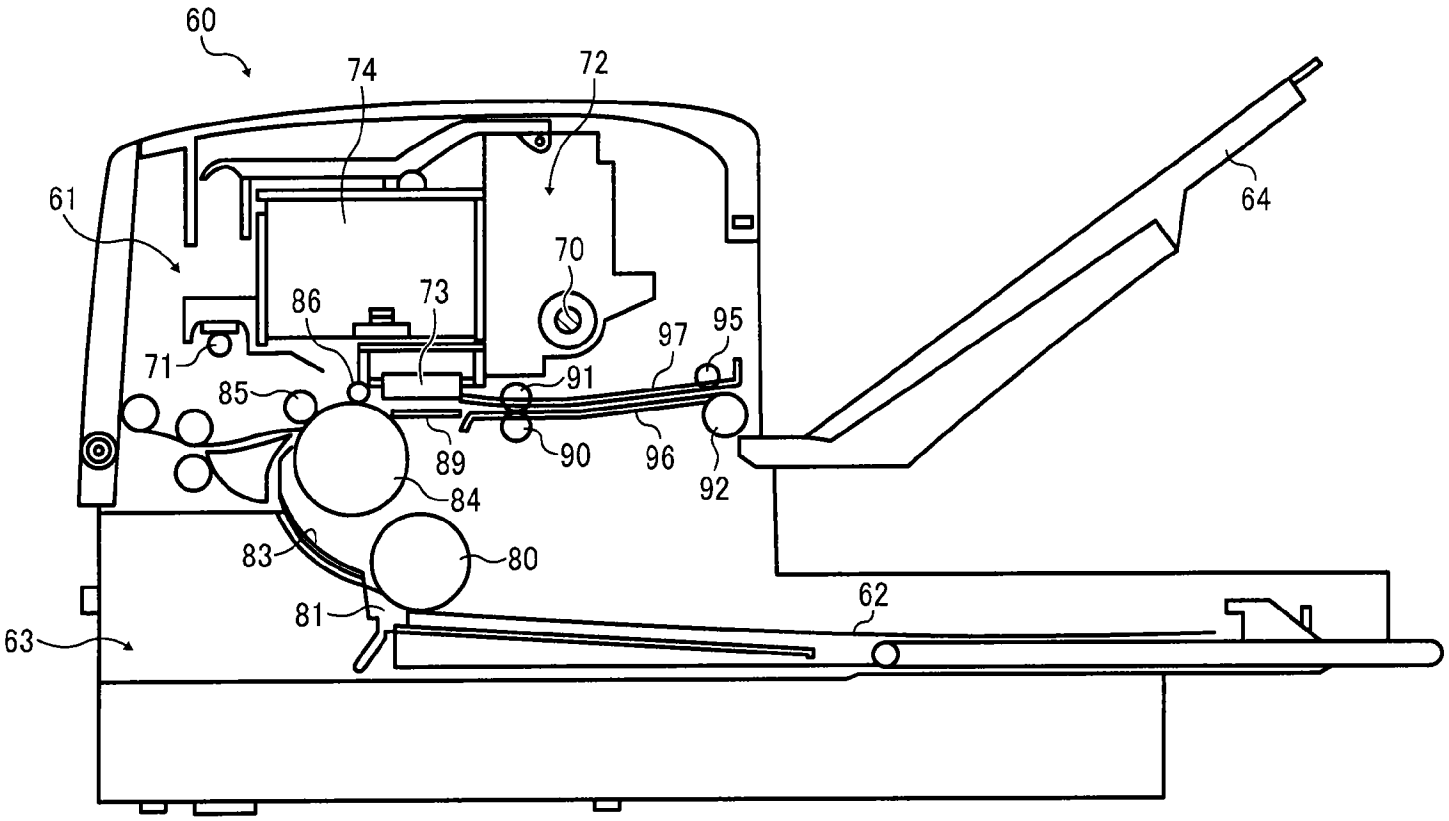
FIG. 5 is a side view of the mechanical unit of the image forming apparatus illustrated in FIG. 4.

FIG. 4 is a perspective diagram illustrating the configuration of the image forming apparatus as an example of the liquid droplet discharging device relating to an embodiment of the present disclosure. FIG. 5 is a side view of the mechanical unit of the image forming apparatus illustrated in FIG. 4. An inkjet type printer (hereinafter referred to as printer) is taken as an example to describe the image forming apparatus.

This printer accommodates a print mechanical unit 61 including a carriage 72, a recording head 73 carried by the carriage 72, and an ink carriage 74 to supply ink to the recording head 73. The carriage 72 is supported movable in the main scanning direction in a printer 60.

At the bottom of the printer 60, a sheet feeding cassette 63 capable of loading a number of sheets 62 is arranged to be drawn in and out from the front. In addition, a bypass tray 64 is arranged to be open down to allow manual feeding of the sheet 62. Therefore, the sheet 62 is taken from the sheet feeding cassette 63 or the bypass tray 64 and a desired image is recorded thereon by the print mechanical unit 61. Thereafter, the sheet 62 is ejected to an ejection tray installed on the rear side.

In the print mechanical unit 61, a main guiding rod 70 and a sub-guiding rod 71 laterally bridged to right and left side plates slidably hold the carriage 72 in the main scanning direction (vertical to the sheet surface of FIG. 5).

This carriage 72 carries the recording head 73 having each exchangeable ink cartridge 74 to supply each color ink. The recording head 73 carries multiple liquid droplet discharging heads 1 described above to discharge each color ink droplet of yellow (Y), cyan (C), magenta (M), and black (Bk). The liquid droplet discharging head 1 has multiple ink discharging holes (nozzle holes) disposed in the direction crossing the main scanning direction with the ink droplet discharging direction downward.

The ink cartridge 74 includes an air hole on the upper side thereof to communicate with air, a supplying hole to supply ink to the liquid droplet discharging head 1 on the bottom side thereof to supply ink, and porous solids filled with the ink inside. The ink supplied to the liquid droplet discharging head 1 is maintained under a negative pressure due to the capillary force of the porous solids. In addition, in this embodiment, the recording head 73 is disposed for each color but can have a configuration of a single liquid droplet discharging head having nozzles to discharge each of the color ink droplets.

The rear end (downstream in the sheet conveyance direction) of the carriage 72 is fitted into the main guiding rod 70 in a slidable manner and the front end (upstream in the sheet conveyance direction) is placed on the sub-guiding rod 71 in a slidable manner. In addition, a timing belt 78 is stretched between a driving pully 76 and a driven pully 77 rotatably driven by a main scanning motor 75. The timing belt 78 is fixed to the carriage 72. Due to the proper and reverse rotation of the carriage 72, the carriage 72 is driven to reciprocate in the main scanning direction.

To convey the sheet 62 placed in the sheet feeding cassette 63 towards the bottom side of the recording head 73, there are disposed a sheet feeding roller 80, a friction pad 81, a guiding member 83, a conveyance roller 84, a conveyance roller 85, and a front end roller 86.

The sheet feeding roller 80 and the friction pad 81 are to separate and feed the sheet 62 from the sheet feeding cassette 63. In addition, the guiding member 83 guides the sheet 62 and the conveyance roller 84 are arranged to reverse and convey the sheet 62. The front end roller 86 is to regulate the sending-out angle of the sheet 62 sent from the conveyance roller 84 and the conveyance roller 85 pressed against the circular surface of the conveyance roller 84. The conveyance roller 84 is rotationally driven by a sub-scanning motor 87 via a gear train.

Also, a print receiver 89 is disposed on the conveyance path to guide the sheet 62 sent out from the conveyance roller 84 corresponding to the moving range of the carriage 72 in the main scanning direction on the side of the bottom of the recording head 73. On the downstream of this print receiver 89 in the sheet conveyance direction, there are provided a conveyance roller 90, a spur 91, a sheet ejection roller 92, a spur 95, and guiding members 96 and 97 to form a sheet ejection path. The conveyance roller 90 and the spur 91 are rotationally driven to send out the sheet 63 in the sheet ejection direction. Also, each of the sheet ejection roller 92 and the spur 95 is rotated to send out the sheet 63 to the sheet ejection tray.

When recording, ink is discharged in an amount corresponding to one line to the sheet 62 not in motion and thereafter the sheet 62 is conveyed in a predetermined amount for recording the next line by driving the recording head 73 in response to image signals while moving the carriage 72. On receiving a signal indicating that recording has completed or the rear end of the sheet 62 has reached the image recording area, the recording operation stops and the sheet 62 is ejected.

In addition, a restoring device 100 is disposed to restore discharging failure of the recording head 73 at the position out of the image recording area on the right end side in the moving direction of the carriage 72. The restoring device 100 includes a capping device, a suctioning device, and a cleaner. The carriage 72 is moved toward the restoring device 100 while standing by for printing and the recording head 73 is capped by the capping device to keep the discharging hole portion in a wet state to prevent discharging failure caused by ink drying. Moreover, by jetting ink having nothing to do with recording in the middle of recording, ink viscosity in all the discharging holes is kept constant to stabilize discharging performance.

When a discharging failure occurs, the discharging hole (nozzle hole) of the recording head 73 is sealed by the capping device, air bubbles, etc. are suctioned from the discharging hole by the suctioning device via a tube together with ink. The ink and dirts attached to the surface of the discharging hole are removed by the cleaner, so that the discharging holes are restored from discharging failure. Moreover, the ink suctioned is ejected to a waste ink storage disposed on the bottom of the printer 60 and absorbed and held in an ink absorbent inside the waste ink storage. As described above, an inexpensive liquid droplet discharging device substantially free from peeling-off of agglutination is provided by applications of the liquid droplet discharging head 1 relating to the present embodiment.

In the embodiment described above, a printer is employed as the liquid droplet discharging device. However, inkjet photocopiers, inkjet facsimile machines, or multifunction peripherals thereof can be also employed as the printer. In addition to printers, this can be applied to industrial manufacturing devices such as color filter manufacturing devices, metal wiring manufacturing devices, textile-printers, and DNA chip manufacturing devices utilizing inkjet technologies.

Next, discharging property of the liquid droplet discharging head 1 and the impact thereof on environment are described. With regard to the thin film piezoelectric substance, the properties are typically stabilized by the process to stabilize the properties after the head is manufactured (such as aging) and during film-forming. However, in an attempt to improve productivity by increasing frequencies, it is found that just the aging described above is insufficient to secure the stabilization of the property. Moreover, thin films involves a peculiar problem of degradation of properties and restoring waveform or restoring treatment are proposed to solve this problem, which is different from the problem to be solved of the present disclosure.

The problem to be solved by the present disclosure lies in changes of properties caused by temperature changes in the external environment when the liquid droplet discharging head 1 is left undone. Some measures are possible to avoid this problem, for example, all the members of the liquid droplet discharging head 1 are made of the same material, configured to be free from adhesives, or subject to massive aging (process of relaxing internal stress and internal distortion). However, these are not practical in terms of limitation on the properties of a head or cost increase. On the other hand, the method relating to the present disclosure is simple and cost-effective to stabilize the change of properties.

The liquid droplet discharging head 1 is connected with a controller (computer) C controlling the entire device as illustrated in FIG. 1. The controller C, which is at least circuitry such as a central processing unit (CPU), is connected with a memory such as a random access memory to store required control programs and demonstrates the following features according to execution of the control program. The controller C may be a substrate etc., to control the head in the device or a PC into which an application is installed.

(1) A feature to apply a property stabilizing voltage to the thin film piezoelectric substance 40 to stabilize properties of the thin film piezoelectric substance 40 between activation of the main power and the start of initial printing. This feature is referred to as "voltage application device Ca". The property stabilizing voltage in this embodiment is equal to or greater than the voltage (drive voltage) applied to drive the thin film piezoelectric substance 40. Such a property stabilizing voltage is applied when installing the control program after the main power activation. "The predetermined property stabilizing voltage" is a direct current or non-discharging waveform described later. These are described in detail later.

(2) A feature to determine whether a predetermined time elapses. This feature is referred to as "elapse time determining device Cb".

Figure 6:
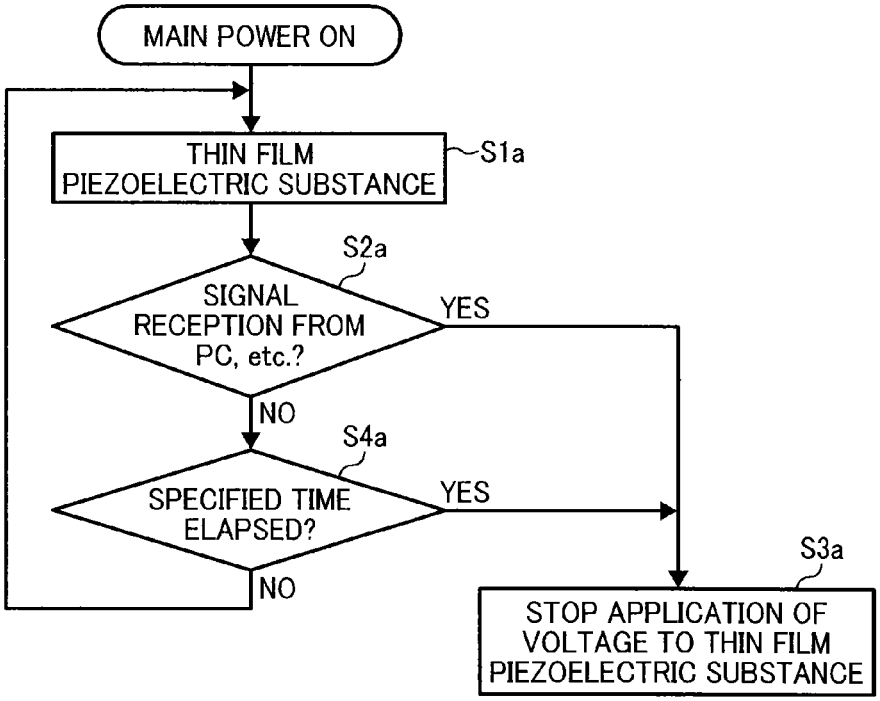
FIG. 6 is a flow chart illustrating the processing between the main power activation and the start of the first print.
Figure 7:
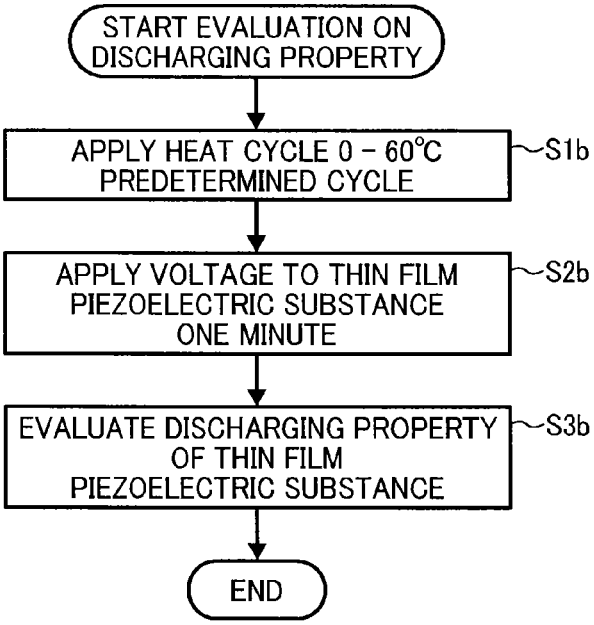
FIG. 7 is a flow chart illustrating the operations of a substantiative experiment conducted after the main power is activated.

Next, the operation immediately after the main power is activated is described referring to FIGS. 6 and 7. FIG. 6 is a flow chart illustrating the operations from when the main power is activated to when the initial printing starts and FIG. 7 is a flow chart illustrating the operations of a substantiative experiment conducted after the main power is activated. The operations of FIGS. 6 and 7 are each performed under control of the controller C of the liquid droplet discharging device.

In FIG. 6, Step 1 is processed when the main power is activated.

Step 1 (represented as S1*a* in FIG. 6. The same shall apply hereinafter): A property stabilizing voltage having a predetermined waveform is applied to the thin film piezoelectric substance 40, and operation proceeds to Step 2.

Step 2: The controller C determines whether a signal is received, and if it is determined that the signal is received, the operation proceeds to Step 3 and if not, to Step 4.

Step 3: The controller C causes to terminate the application of the property stabilizing voltage applied to the thin film piezoelectric substance 40.

Step 4: The controller C determines whether the predetermined time has elapsed or not, and if not, the operation returns to Step 1. If the predetermined time has passed, the operation goes to Step 3 to terminate the application of the property stabilizing voltage applied to the thin film piezoelectric substance 40.

As described above, when the main power is activated, for example, at a customer site, the property stabilizing voltage as described above, which has a potential equal to or greater than a midpoint potential, is applied to the liquid droplet discharging head 1. The waveform of the applied voltage at this point in time can be, for example, a direct current or a non-discharging waveform as long as it is higher than the midpoint potential at actual discharging.

While continuing the state in which the property stabilizing voltage is applied, the control programs are installed to a PC, etc. and when an identifying signal of the printer is sent, the application of the property stabilizing voltage is terminated in synchronization with the signal. In addition, if the synchronization of the printer is not conducted, the application of the property stabilizing voltage is terminated after a certain time (for example, one minute). By the application of the property stabilizing voltage, the impact on the liquid droplet discharging head 1 receiving from the external heat history before the main power is activated is reset. Immediately thereafter, the printer can be stably used.

With regard to the application of the property stabilizing voltage, the experimental flow chart evaluating and verifying that a direct current and a non-discharging waveform are suitable is illustrated in FIG. 7. The basic discharging property of the liquid droplet discharging head 1 is evaluated in the following procedure (corresponding to pre-shipment inspection).

Step 1 (represented as "S1*b*" in FIG. 7. The same shall apply hereinafter.): Next, the liquid droplet discharging head 1 is set in a heat cycle (corresponding to transport of a printer and resting in a warehouse). The heat cycle this time is 10 cycles in the temperature range of from 0 to 60 degrees C.

Step 2: The property stabilizing voltage having a waveform which is applied at the activation of the main power is applied.

Step 3: Ink droplets are continuously discharged and the transition of the discharging speed is measured. As the application waveform, what is less changed during the transition of the discharging speed is suitable.

EXAMPLES

The present invention is described in detail with reference to the accompanying drawings.

Example 1

Figure 8:
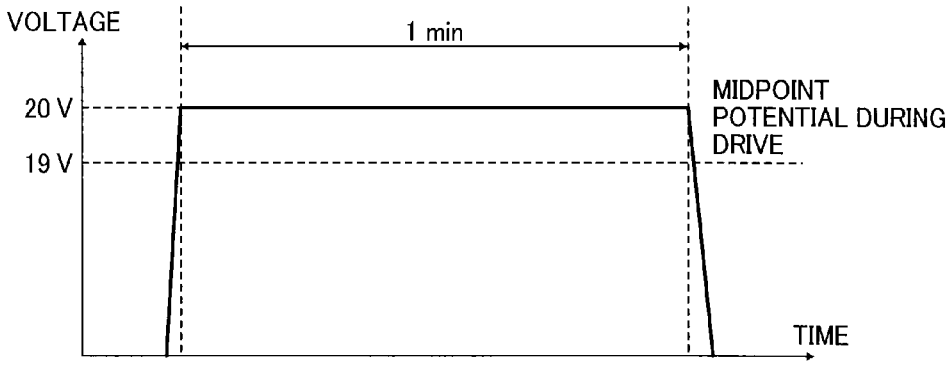
FIG. 8 is a graph illustrating the measuring result of the transition of the discharging speed when a direct voltage equal to or greater than the midpoint potential is applied for one minute.

FIG. 8 is a graph illustrating the measuring result of the transition of the discharging speed when a direct voltage equal to or greater than the midpoint potential is applied for one minute. X axis represents the applied voltage and Y axis represents time. The midpoint potential of the liquid droplet discharging head 1 is 19 V and the property stabilizing voltage of the direct current applied when the power is activated is 20 V. It is possible to reduce the power consumption by using DC as the waveform.

Example 2

Figure 9:
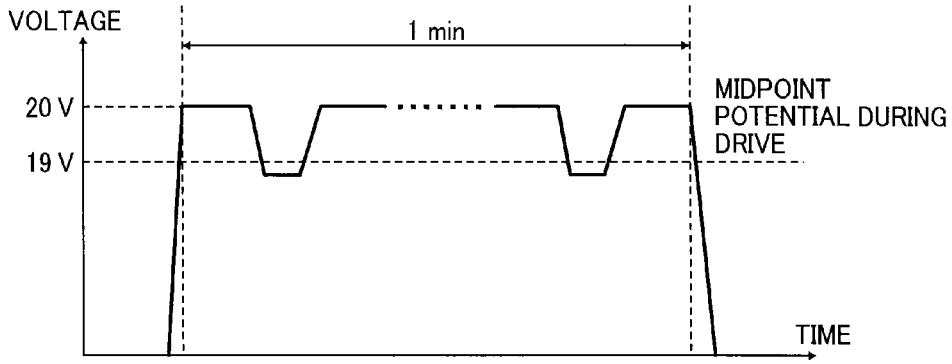
FIG. 9 is a graph illustrating the measuring result of the transition of the discharging speed when an alternating voltage equal to or greater than the midpoint potential is applied for one minute.

FIG. 9 is a graph illustrating the measuring result of the transition of the discharging speed when an alternating voltage equal to or greater than the midpoint potential is applied for one minute. X axis represents applied voltage and Y axis represents time. At voltage equal to or greater than the midpoint potential (20V, the same as above), a property stabilizing voltage having a fine drive waveform to protect the liquid droplet discharging head 1 from being dried is applied for one minute to measure the transition of the discharging speed. The fine drive waveform is that the rise time and the fall time are 1 us for each with a pulse width of 3 us and a trapezoid waveform from 20 to 15 V is repeatedly applied with a repeating cycle of 1 kHz. The non-discharging waveform is not limited to those illustrated in the drawings. This waveform is applied as a mere example of the non-discharging waveform. Due to the application of the non-discharging waveform, stability can be secured in a short time.

Comparative Example 1

Figure 10:
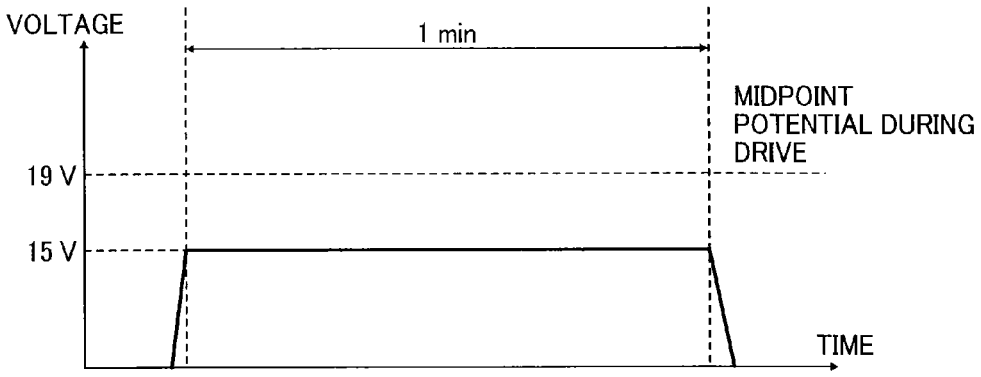
FIG. 10 is a graph illustrating the measuring result of the transition of the discharging speed when a direct voltage of 15 V, which is lower than the midpoint potential, is applied for one minute.

FIG. 10 is a graph illustrating the measuring result of the transition of the discharging speed when a direct voltage of 15 V, which is lower than the midpoint potential, is applied for one minute. X axis represents applied voltage and Y axis represents time.

Comparative Example 2

Figure 11:
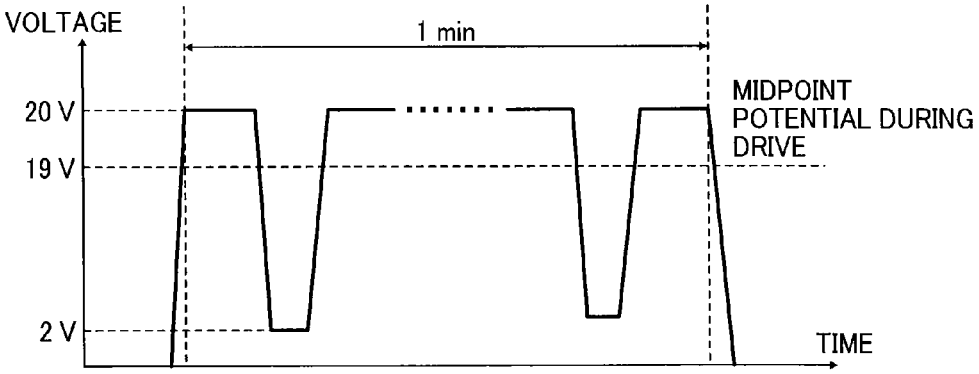
FIG. 11 is a graph illustrating the measuring result of the transition of the discharging speed when a property-stabilizing voltage having a discharging waveform at an midpoint potential of 20 V, which is not less than the midpoint potential is applied for one minute.

FIG. 11 is a graph illustrating the measuring result of the transition of the discharging speed when a property-stabilizing voltage having a discharging waveform at an midpoint potential of 20 V, which is not less than the midpoint potential, is applied for one minute. The discharging waveform is that the rise time and fall time are 1 us for each with a pulse width of 1.5 us and a trapezoid waveform from 20 to 2 V is repeatedly applied with a repeating cycle of 1 kHz. The discharging waveform is not limited to those illustrated in the drawings. This waveform is applied as a mere example of the discharging waveform.

Figure 12:
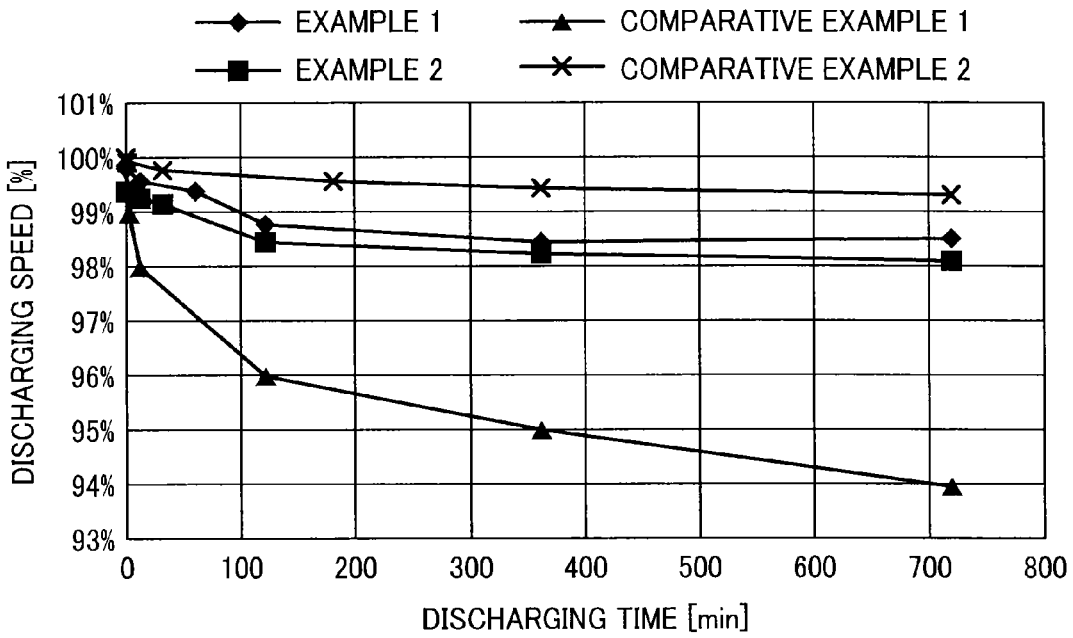
FIG. 12 is a graph illustrating the relation between the discharging speed and the discharging time of ink droplets.

Each transition is shown in the graphs illustrated in FIG. 12. FIG. 12 is a graph illustrating the relation between the discharging speed and the discharging time of ink droplets. In FIG. 12, X axis represents the discharging the speed of ink droplets and Y axis represents the discharging time. As illustrated in FIG. 12, the transition is less than 2 percent in Examples 1 and 2 and Comparative Example 2. Although stable, Comparative Example 1 is found that the change at the start of discharging is large. Judging from this, Comparative Example 1 is found to be unsuitable in terms of the discharging stability. Also, with regard to Comparative Example 2, the discharging stability is secured but the ink droplets are discharged in the middle of the stabilization. That is, it is extremely expensive so that Comparative Example 2 is not suitable as a product.

As seen in the description above, it is preferable to apply a property stabilizing voltage having the waveform illustrated in FIG. 1 or 2 or a waveform similar to those. In addition, with regard to the application time length, the longer, the better for stabilization. However, taking into account limitation on usage such as initial setting time at arrival of shipment, one minute is selected in the test. The time is just an example for Examples and not naturally limited to one minute.

Example 3

Figure 13:
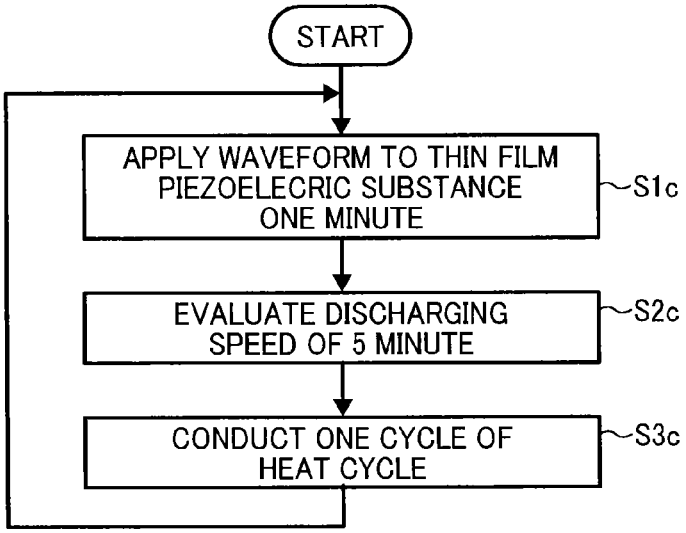
FIG. 13 is a flow chart illustrating the procedure of the test for confirming the repeating effect.
Figures 14, 15:
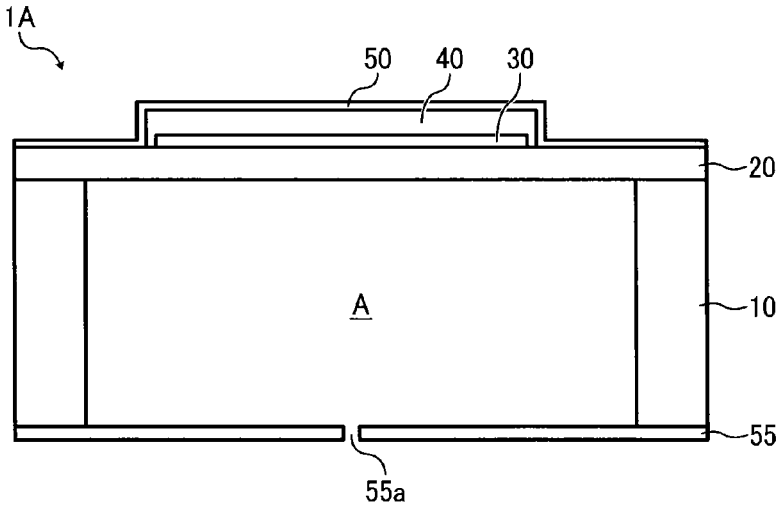
FIG. 14 is a table illustrating the difference in the discharging speed between the start and the end in the transition for five minutes.
FIG. 15 is a schematic front view of the liquid droplet discharging head relating to another example for use in the liquid droplet discharging head according to an embodiment of the present invention.

In addition, with regard to the effect of repetition, an experiment was conducted following the procedure shown in the flow chart illustrated in FIG. 13. FIG. 13 is a flow chart illustrating the procedure of verification experiment on the effect of the repetition and FIG. 14 is a table illustrating the difference in the discharging speed between the start and the end in the transition for five minutes. FIG. 13 is performed under control of the controller C.

As illustrated in Step 1 (represented as "S1*c*" in FIG. 13. The same shall apply hereinafter.), a voltage having a predetermined waveform is applied for one minute.

Step 2: The transition is measured for continuous discharging evaluation for five minutes.

Step 3: One cycle of the heat cycle was conducted while being capped.

The experiment of from Step 1 to Step 3 was repeated several times. Moreover, the table illustrated in FIG. 14 was created based on the difference in the discharging speed between the beginning and the end of the transition for five minutes. The table illustrated in FIG. 14 indicates data for three repetitions.

As illustrated in FIG. 14, similar results are obtained as the results described above even when repeated. Therefore, for example, at seasonal usage represented by season greetings (for example, New Year's greeting cards in Japan), it is possible to stably use a liquid droplet discharging head by the waveform application treatment mentioned above. That is, this applies to when a printer is not powered on and left undone for a while and thereafter is activated again.

According to the liquid droplet discharging device described above, what is obtained is as follows. At arrival of shipment, if a voltage is applied to a thin film piezoelectric substance at the time of power activation and the application is maintained, the thin film piezoelectric substance in a random state at the arrival of shipment can be changed into a stabilized state. In addition, this voltage is applied during the initial setting at the power activation after the arrival of shipment. Therefore, users can stably use the liquid droplet discharging head without delay.

Moreover, while a control device (e.g., an IC for controlling installed onto the liquid droplet discharging head) of the liquid droplet discharging device is sending and receiving predetermined signals with a device (controller) (PC, etc.) connected with and control the liquid discharging device, what is obtained by an application of a voltage during installation of the control program after activation of the main power is, for example, as follows. That is, at arrival of shipment, the heat history therebefore affects the device and the discharging state tends to be particularly unstable. Therefore, while setting the computer at the arrival of shipment, a voltage is applied to secure the stability of the liquid droplet discharging head, so that it is possible to start stable printing without making a user wait. When the controller is a PC, the control device is a substrate to control in the liquid droplet discharging device.

In addition, according to an instruction of the controller of the liquid droplet discharging device, a voltage is applied during execution of predetermined setting process conducted before starting printing by the control device of the liquid droplet discharging device. What can be obtained is as follows. That is, when the main power is activated at the time other than the arrival of shipment, the device has been left undone until the activation. The device may be affected by the environment during the period of being left undone but this impact can be canceled. Also, it is possible to start printing without making a user wait because the voltage is applied during setting the printing.

Figure 16:
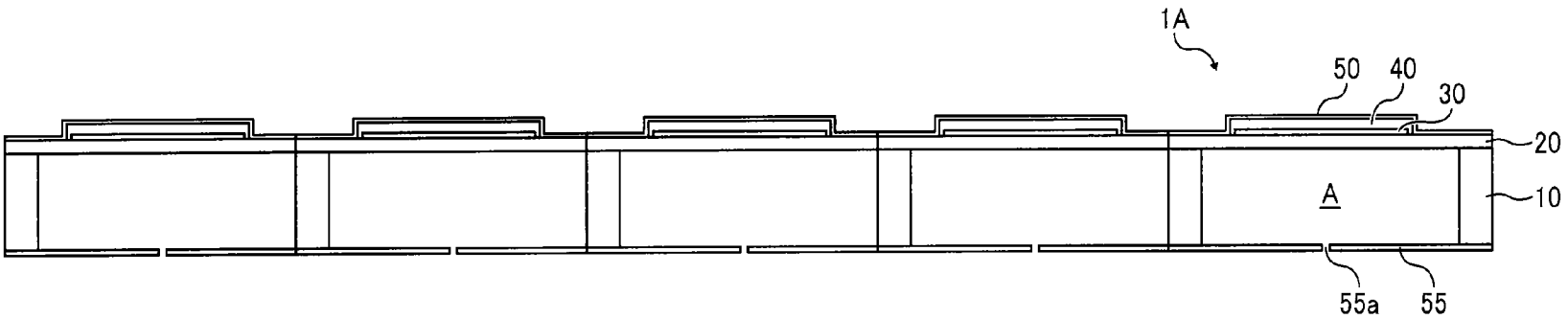
FIG. 16 is a side view of the liquid droplet discharging head relating to the another example illustrated in FIG. 15.

Next, the liquid droplet discharging head relating to another example is described with reference to FIGS. 15 and 16. FIG. 15 is a schematic front view of the liquid droplet discharging head relating to the another example. FIG. 16 is a side view of the liquid droplet discharging device relating to the example. In FIGS. 15 and 16, what is equivalent to those illustrated in FIGS. 1 and 2 is referenced by the same number and the description thereof is omitted.

In a discharging head 1A relating to the another example illustrated in FIGS. 15 and 16, there are arranged the vibration plate 20, the bottom electrode 30, the thin film piezoelectric substance 40, and the top electrode 50 sequentially laminated on the top part of the pressurized chamber substrate 10 and the nozzle plate 55 is agglutinated to the bottom part of the pressurized chamber substrate 10. That is, while the liquid droplet discharging head 1 relating to the example illustrated in FIGS. 1 and 2 has the bottom electrode 30 as the common electrode and the top electrode 50 as the individual electrode, the liquid droplet discharging head 1A relating to the another example has the bottom electrode 30 as the individual electrode and the top electrode 50 as the common electrode. According to this configuration, the same effect is achieved.

According to the present disclosure, a liquid droplet discharging device is provided which is capable of easily and quickly stabilizing the properties of a thin film piezoelectric substance at the start of use.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming device, comprising:

a liquid droplet discharging head including a nozzle hole, a pressurized liquid chamber communicating with the nozzle hole, a vibration plate constituting a side of the pressurized liquid chamber, a control device, and a thin film piezoelectric substance configured to vibrate the vibration plate by a drive voltage to discharge liquid droplets; and a voltage application device configured to apply a voltage waveform which is a direct current having a potential which is equal to or greater than a midpoint potential applied when the thin film piezoelectric substance is driven, the voltage waveform which is applied being applied after a main power of the image forming device is supplied to the image forming device and prior to when a first print starts.

2. The image forming device according to claim 1, wherein:

the voltage application device applies the voltage waveform while a predetermined signal is sent and received between the control device and a controller connected with the liquid droplet discharging device to control the liquid droplet discharging device.

3. The image forming device according to claim 1, wherein:

the voltage application device applies the voltage waveform while a controller of the liquid droplet discharging device is executing a pre-printing setting processing of the liquid droplet discharging device.

4. The image forming device according to claim 1, wherein the voltage applied by the voltage application device applies a predetermined non-discharging waveform.

5. The image forming device according to claim 1, wherein:

the voltage application device stops applying the voltage waveform in response to receipt of a signal indicating a start of printing is to occur.

6. The image forming device according to claim 1, wherein:

the voltage application device stops applying the voltage waveform in response to a predetermined period of time expiring.

7. A liquid droplet discharging device, comprising:

a liquid droplet discharging head including a nozzle hole, a pressurized liquid chamber communicating with the nozzle hole, a vibration plate constituting a side of the pressurized liquid chamber, a control device, and a thin film piezoelectric substance configured to vibrate the vibration plate by a drive voltage to discharge liquid droplets; and a voltage application device configured to apply a voltage waveform having a voltage equal to or greater than the drive voltage between when a main power is activated and when a first print starts, wherein the voltage applied by the voltage application device is a direct current equal to or greater than a midpoint potential applied when the thin film piezoelectric substance is driven.

* * * * *